US006183195B1

(12) United States Patent
Tremaine

(10) Patent No.: US 6,183,195 B1
(45) Date of Patent: Feb. 6, 2001

(54) SINGLE SLOT IMPELLER BLEED

(75) Inventor: Eric Tremaine, Longueuil (CA)

(73) Assignee: Pratt & Whitney Canada Corp., Longueuil (CA)

( * ) Notice: Under 35 U.S.C. 154(b), the term of this patent shall be extended for 0 days.

(21) Appl. No.: 09/244,134

(22) Filed: Feb. 4, 1999

(51) Int. Cl.[7] ..... F01D 17/00

(52) U.S. Cl. ..... 415/145; 415/1; 415/26; 415/914; 415/173.2

(58) Field of Search ..... 415/145, 26, 1, 415/914, 144, 173.1, 173.2

(56) References Cited

U.S. PATENT DOCUMENTS

| | | | | |
|---|---|---|---|---|
| 2,405,282 | * | 8/1946 | Birmann | 415/167 |
| 4,248,566 | | 2/1981 | Chapman et al. | 415/914 |
| 4,439,104 | | 3/1984 | Edmonds | 415/161 |
| 4,479,755 | | 10/1984 | Skoe | 415/144 |
| 4,687,412 | | 8/1987 | Chamberlain | 415/173.1 |
| 4,743,161 | | 5/1988 | Fisher et al. . | |
| 4,930,979 | | 6/1990 | Fisher et al. | 415/914 |
| 5,236,301 | | 8/1993 | Palmer . | |
| 5,246,335 | | 9/1993 | Mitsubori et al. | 415/914 |
| 5,333,990 | | 8/1994 | Foerster et al. . | |
| 5,380,151 | | 1/1995 | Kostka et al. | 415/145 |

* cited by examiner

*Primary Examiner*—F. Daniel Lopez
*Assistant Examiner*—Richard Woo
(74) *Attorney, Agent, or Firm*—Jeffrey W. Astle

(57) ABSTRACT

A structure and a method to form the structure are provided for an impeller bleed passage of a compressor for a gas turbine engine. The compressor has an impeller assembly which includes an impeller rotor rotatably supported within an annular shroud having an inlet and an outlet. The shroud is made of two separate annular segments which are axially spaced apart. Each of the segments is supported separately and independently in a cantilevered manner. Such that a circumferentially continuous, uninterrupted annular slot is formed between the two segments and air passes through the slot without causing a dynamic component to affect the impeller rotor. The width of the slot is adjustable for different engines depending on the requirements of use of a particular engine. The width of the slot is also self-regulating in response to changes in the air pressure within the shroud because of the deformation of the segments. The structure is relatively simple and inexpensive to manufacture.

21 Claims, 1 Drawing Sheet

SINGLE SLOT IMPELLER BLEED

TECHNICAL FIELD

This invention relates to compressors for use in gas turbine engines and, more particularly, to centrifugal compressors including air bleed in association therewith for regulating the operating characteristics of the compressor.

BACKGROUND OF THE INVENTION

In gas turbine engines for use in powering aircraft, air is directed through multiple stage compressors as it flows axially or axially and radially through the engine to a burner. As the air passes through each successive compressor stage, the pressure of the air is increased. Under certain conditions, such as when the engine is throttled back or during start-up, the compressor pumping capacity is significantly reduced. In this condition, an engine surge or blow-out may occur, endangering the operation of the engine and the associated aircraft. In the past, it has been recognized that inadequate surge margin in such compressors could be eliminated by bleeding a substantial percentage of the compressor air flow at strategic locations along the gas path.

It has been proposed in U.S. Pat. No. 4,248,566 which is entitled DUAL FUNCTION COMPRESSOR BLEED and issued to Chapman et al. on Feb. 3, 1981, to form an annular control slot in the stationary shroud so as to allow the inflow of air from outside the shroud to the rotor chamber under high r.p.m. conditions of the compressor operations and to allow air flow to bleed from the rotor chamber to the exterior of the shroud when the rotor is operating at a low r.p.m. whereby to stabilise the flow of the rotor at low r.p.m. operation. Nevertheless, the annular slot disclosed in this patent is not circumferentially continuous and the radial air flow is affected by reinforcing bridges on the shroud. The reinforcing bridges connect the two parts of the shroud separated by the slot and serve to carry structural roads.

It is also suggested that separate holes in a circumferential row could replace the annular slot as long as the desired bleed flow area is maintained. The outer tip of the impeller bleed will be effected by the local pressure variation when the outer tip of each blade sweeps from an area having open bleed passages to an area without bleed passages or blocked by the bridges, which is an undesirable dynamic component to the compressor operation.

To increase the engine r.p.m. over which compressors can operate in a stable manner, U.S. Pat. No. 4,743,161 entitled COMPRESSORS which issued to Fisher et al. on May 10, 1998, discloses a compressor having an air bleed passage in communication with the normal intake so that the air is thus not bled to the exterior of the impeller housing, and thus atmosphere, nor drawn in from the exterior atmosphere separately from the normal gas intake to the compressor, as in U.S. Pat. No. 4,248,566, but is bled back to the normal intake or is drawn from the normal intake. In one embodiment illustrated in FIG. 5 of U.S. Pat. No. 4,743,161, a circumferentially continuous annular slot is provided for communication with the chamber in which the impeller wheel rotates and an annular chamber. The annular chamber also communicates with the intake through a series of holes. However, the gas pressure is released in the intake rather than the annular chamber. The gas bleed passage includes not only the annular slot but also the annular chamber and the series of holes. The bleed gas flow is not circumferentially even because of the holes and the circumferential pressure variation causes the dynamic component and affects the outer tips of the impeller, particularly, in the case where the holes are close to the outer tip of the blade, which is illustrated in the Figure.

Bleed valves are also used for gas turbine engines to provide adjustable bleed passages. U.S. Pat. No. 5,380,151 which issued to Kostka et al. on Jan. 10, 1995 and entitled AXIALLY OPENING CYLINDRICAL BLEED VALVE, is an example. In this patent, Kostka discloses a bleed valve for a gas turbine engine having a housing made of two segments and which forms a gas flow path through the compressor. A first segment is moveable from the second segment thereby creating an opening therebetween. The moveable segment has one or more arms with rollers attached thereto where the stationary segment defines recessed paths in which the rollers travel. The moveable segment is caused to move away from the stationary segment thereby opening the valve. Because the arms extend across the annular opening between the two segments to moveably connect the two segments, the bleed passage provided by the valve is faced with the same problem as discussed in the above prior art, that is, a dynamic component is created to affect the blades when the air passes through the bleed passage. Further, the arms, rollers and the travel path fixed to the bleed valve segments add weight and machining operations to the construction of the valve which translates into additional manufacturing costs.

Therefore, there exists a need for a structure for an impeller bleed passage of a compressor for a gas turbine engine which eliminates the dynamic component that affects the blades of the impeller when air passes through the bleed passage. It is also desirable to provide a structure for an adjustable bleed passage that is relatively simple and inexpensive to manufacture.

SUMMARY OF THE INVENTION

An object of the invention is to provide a structure for an impeller bleed passage of a compressor for a gas turbine engine, to minimise dynamic components which affect the impeller blades when air passes through the bleed passage.

Another object of the invention is to provide a structure for an impeller bleed passage of a compressor for a gas turbine engine, having a minimum width of the bleed passage to decrease operational inefficiency of the compressor caused by the air bleed.

Another object of the invention is to provide a structure for an impeller bleed passage of a compressor for a gas turbine engine, having a width of the bleed passage that is adjustable for different engines depending on the requirements of use of a particular engine.

Yet another object of the invention is to provide a structure for an impeller bleed passage of a compressor for a gas turbine engine, having a width of the bleed passage that is self-regulating in response to changes in the air pressure within the impeller chamber.

A further object of the invention is to provide a structure for impeller bleed passage of a compressor for a gas turbine engine that is relatively simple and inexpensive to manufacture.

In accordance with one aspect of the invention a compressor for a gas turbine engine is provided, which includes an annular shroud having an inlet end, an outlet end and an inner surface; a compressor rotor located within the shroud including a plurality of blades directed radially and outwardly from the rotor. The annular shroud comprising:

an upstream annular segment and a downstream annular segment independently supported and axially spaced apart to form a circumferentially continuous uninterrupted annular slot therebetween, such that the annular slot extends through the shroud.

Preferably, at least one of the segments being elastically deformable so that a width of the slot changes in response to changes in air pressure within the shroud during operation of the compressor. Preferably, the downstream annular segment is elastically deformable.

The slot width is preferably adjustable for different engines depending on requirements of use of a particular engine.

In accordance with another aspect of the invention, a compressor for a gas turbine engine is provided, which includes a stationary annular shroud having an inlet end and an outlet end and an inner surface; a rotor located within the shroud including a plurality of blades directed radially and outwardly from the rotor, each blade having an outer tip that is of similar contour to and located in a close spaced relationship to the inner surface of the shroud; the annular shroud comprising:

an upstream annular segment and a downstream annular segment axially spaced apart to form a circumferentially continuous uninterrupted annular slot therebetween, the annular slot extending through the shroud, the upstream annular segment being supported by a first structure and the downstream annular segment being supported by a second structure, each of the upstream and downstream annular segments being independent and self-supporting at a peripheral edge adjacent the slot so that when the compressor is in operation, air passes through the continuous annular slot without causing a dynamic component which affects the blades.

The first structure is preferably an inducer which includes an annular passage in communication with the shroud at the inlet end for introducing air flow through the shroud. The second structure is preferably a casing by which the rotor is rotatably supported.

In accordance with a further aspect of the invention there is provided a method for providing an air bleed passage in association with a compressor for use in gas turbine engines, the compressor having an impeller assembly which including an impeller rotor rotatably supported within an annular shroud having an inlet and an outlet, comprising:

producing the impeller shroud in two separate annular segments having an upstream annular segment and downstream annular segment;

supporting the upstream and downstream annular segments separately and independently in an axially spaced apart relationship to form a circumferentially continuous, uninterrupted annular slot therebetween, such that the annular slot extends through the shroud.

The upstream and downstream annular segments are preferably mounted respectively to a first and a second structures in a cantilevered manner, each of the upstream and downstream annular segments independent and self-supporting at a peripheral edge adjacent the slot so that when the compressor is in operation, air passes through the continuous, uninterrupted annular slot without causing a dynamic component which affects the impeller rotor.

BRIEF DESCRIPTION OF THE DRAWINGS

The invention will be better understood from the following description of a preferred embodiment, as an example only, in conjunction with reference to the accompanying drawings, in which.

DETAILED DESCRIPTION OF THE PREFERRED EMBODIMENT

Figure 1:
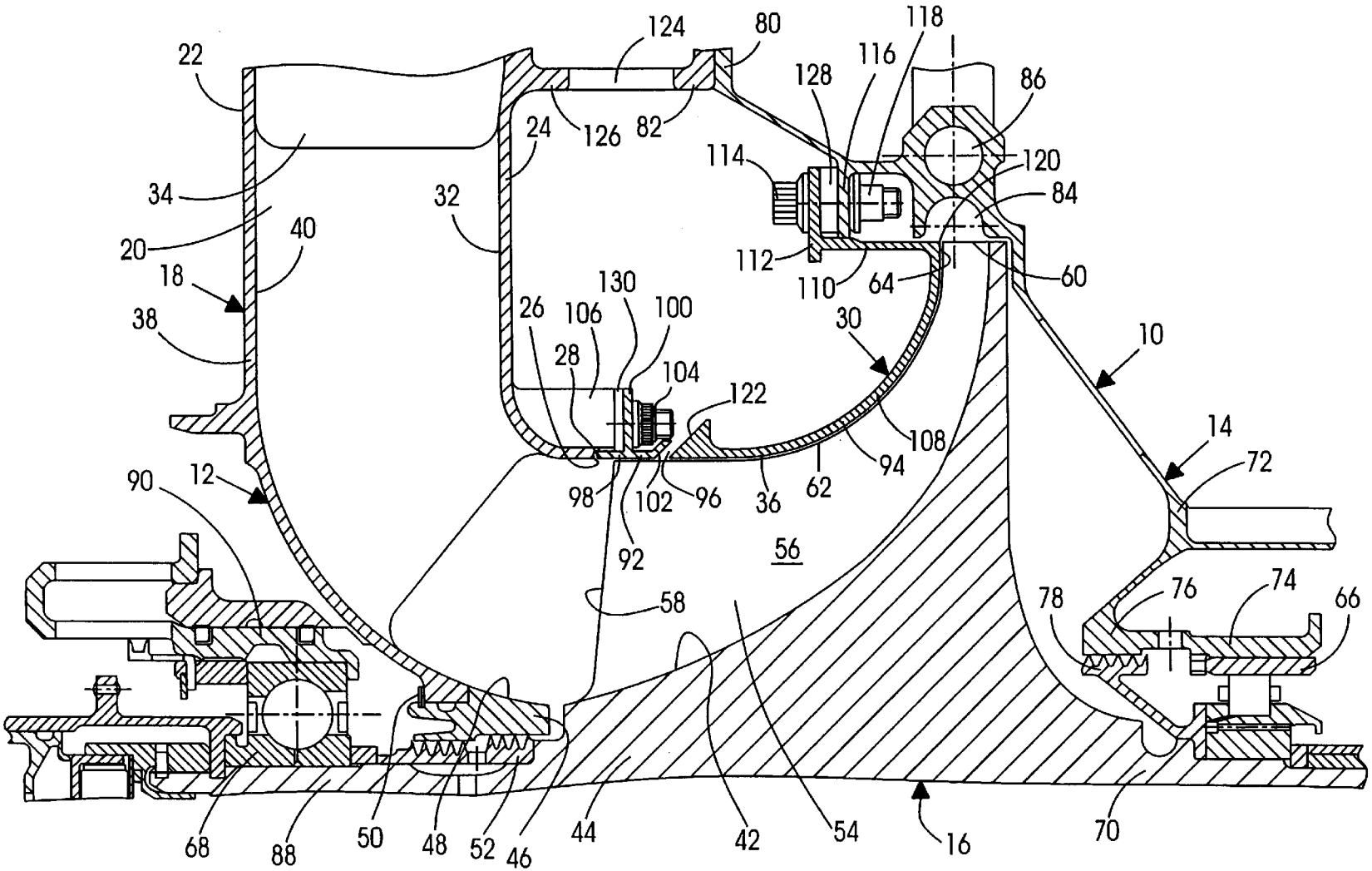
FIG. 1 is a fragmentary, longitudinal section of a compressor including the preferred embodiment of the invention.

Referring now to the drawing, a compressor 10 is shown in FIG. 1. It includes an upstream support assembly 12 and a downstream support assembly 14 for physically locating a compressor impeller assembly 16 of the compressor 10, in a manner to be discussed. More particularly, the upstream support assembly 12 is made up of an annular inducer 18 for introduction of air flow to the compressor impeller assembly 16. The inducer 18 has a plurality of circumferentially spaced radial stator vanes 20 located in a generally axial direction across an annular, radial passage 22 for directing air to the compressor impeller assembly 16 which is interposed between the upstream support assembly 12 and the downstream support assembly 14.

The annular radial passage 22 includes a outer annular shroud 24 having a stepped shoulder 26 on the downstream end thereof for accommodating an inlet end 28 of a impeller shroud 30. The outer annular shroud 24 has a contour that defines a smooth path surface 32 of the inducer fluid path 34 that extends smoothly from a radial direction to an axial direction to prevent abrupt flow changes upstream of a contoured inner surface 36 of the impeller shroud 30. Likewise, the annular radial passage 22 includes an inner annular shroud 38 that extends smoothly from a radial direction to an axial direction and defines a smooth surface 40 of the flow path 34 to avoid abrupt flow changes through the flow path 34 to the contoured hub surface 42 on an impeller hub 44 of the compressor impeller assembly 16.

An abradable annular seal assembly 46 is provided between the inner annular shroud 38 and the impeller hub 44 and includes a contoured surface 48 that defines a smooth transition between the surface 40 of the inner annular shroud 38 and the hub surface 42. The abradable seal assembly 46 is attached to the inner annular shroud 38 at the downstream end thereof and held in position by a spring ring 50. The abradable seal assembly 46 includes a labyrinth seal member 52 on the impeller hub 44 to seal the internal air flow path through the compressor assembly 10 from low pressure cavities within the compressor.

The air flow path through the compressor impeller assembly 16 is arranged to produce as uniform a flow as possible from the inducer 18 to an annular impeller chamber 54 defined by the impeller hub 44 and the impeller shroud.

More particularly, the impeller chamber 54 is formed between the inner surface 36 of the impeller shroud 30 and the hub surface 42 of the impeller hub 44. A plurality of impeller blades 56 extend radially and axially from the impeller hub 44. Each of the blades 56 includes a leading edge 58, a trailing edge 60 and an outer tip 62. The leading edge 58 of the impeller blade 56 is located at the inlet end 28 of the impeller shroud 30 and the trailing edge 60 is located at an outlet end 64 of the impeller shroud 30. The outer tip 62 of the impeller blade 56 extends, starting from the leading edge 58 and ending to the trailing edge 60, smoothly from an axial direction to an outwardly radial direction and follows the contour of the inner surface 36.

The compressor impeller assembly 16 is supported for rotation with respect to the contoured inner surface 36 of the impeller shroud 30 by a rear bearing assembly 66 and a front bearing assembly 68. The rear bearing assembly 66 supports a rear hub extension 70. The impeller hub 44 is mounted on a compressor drive shaft, not shown, and is driven by the drive shaft during compressor operation. The downstream support assembly 14 includes a casing 72, a bearing support 74 and an abradable seal land member 76. Both the bearing support 74 and the abradable seal land member 76 are formed integrally with the casing 72. The bearing support 74 receives and supports the bearing assembly 66. The abradable seal land member 76 cooperates with a labyrinth seal 78 on the impeller hub 44 to seal the internal air flow path through the compressor assembly 10 from low pressure cavities within the compressor. The casing 72 includes a front flange 80 that is connected with a rear flange 82 of the inducer 18 for supporting the inducer 18. An annular diffuser groove 84 is formed in the casing 72 and in the same radial plane as the outlet end 64. The air flow passes through a pipe diffuser 86, to eventually communicate with the combustion chamber of the engine, as well as provide cooling for the compressor assembly, not shown.

The front bearing assembly 68 supports a front hub extension 88 to permit the rotation of the compressor impeller assembly 16. The front bearing assembly 68 in turn is received and supported by a front bearing support 90 that is supported with respect to a stationary structure of the compressor, not shown.

The impeller shroud 30 includes an upstream annular segment 92 and a downstream annular segment 94 which are axially spaced apart, forming a circumferentially continuous uninterrupted annular slot 96 between the two segments 92, 94. The upstream annular segment 92 has an cylindrical portion 98 and a radial flange 100 extending outwardly from the cylindrical portion 98. The upstream end of the cylindrical portion 98 is snugly fit in the stepped shoulder 26 of the outer annular shroud 24 of the inducer 18, forming the inlet end 28 of the impeller shroud 30.

The downstream end of the cylindrical portion 98 has frusto-conical surface 102 extending outwardly and rearwardly. A plurality of holes, not shown, extend through the radial flange 100, circumferentially and equally spaced apart for receiving studs and nuts 104.

The studs are respectively secured in screw holes, not shown, in a plurality of bosses 106 that are circumferentially formed on the outer annular shroud 24 at the downstream end thereof. The cylindrical portion 98 of the upstream annular segment 92 is short in axial length relative to the full length of the outer tip 62 of the impeller blade 56 and the annular slot 96 is therefore located in a position so as to allow an inflow of air from outside of the impeller shroud 30 to the impeller chamber 54 under high r.p.m. conditions of compressor operations and to allow air flow to bleed from the impeller chamber 54 to the exterior of the impeller shroud 30 when the compressor is operating at a lower r.p.m. to stabilise the flow to the impeller rotor at part r.p.m. operation, which is disclosed in U.S. Pat. No. 4,248,566. The downstream annular segment 94 includes a contoured section 108 which is a major section of the inner surface 36 of the impeller shroud 30. The inner surface 36 is contoured to the outer tip 62 of the impeller blade 56. The downstream annular segment 94 further includes a cylindrical portion 110 and a flange 112 on the downstream end thereof to be supported by the casing 72 in a cantilevered manner. A plurality of holes, not shown, are circumferentially and equally spaced apart and extend through the flange 112 for receiving connection bolts 114. A plurality of corresponding holes, not shown, are provided respectively in a plurality of scallops 116 which are circumferentially and equally spaced apart, formed integrally with the casing 72 and connected to the flange 112. The connection bolts 114 co-operate with nuts 118 to fasten the flange 112 and the scallops 116 together. Edge 120 formed at the juncture of the contoured section 108 and the cylindrical portion 110 defines the outlet end 64 of the impeller shroud 30.

The downstream annular segment 94 defines a rein on the upstream end with a ramp (frusto-conical) surface 122 thereon. The ramp surface 122 is parallel to the frusto-conical surface 102 of the upstream annular segment 92 and is spaced apart therefrom to form the annular slot 96.

Because the upstream annular segment 92 is fixed to the inducer 18 and the downstream annular segment 94 is mounted to the casing 72, there is no connecting member to directly bridge the two segments, each segment being independent and self-supporting at a peripheral edge adjacent the slot. Thus when the compressor is in operation, air passes through the continuous annular slot 96 without causing a dynamic component to affect the blades as discussed.

The air surrounding the exterior of the impeller shroud 30 is in communication with the ambient air through a plurality of openings 124 in an annular frame 126 that extends downstream from the outer annular shroud 24 of the inducer 18 to mount the rear flange 82. The annular frame 126 is located relatively remote from the annular slot 96 and there is plenty of air volume between the annular frame 126 and the exterior of the impeller shroud 30 to eliminate any dynamic component caused by the annular frame 126, if any, which can affect the impeller blade 56 when the air passes through the annular slot 96 and the openings 124.

A rear spacer 128 with a predetermined thickness is provided between the flange 112 of the downstream annular segment 94 and the scallops 116 of the casing 72 at each bolt connection to set an axial location of the downstream annular segment 94. The inner surface 36 of the impeller shroud 30 is set in closely spaced relationship with the outer tips 62 of the impeller blades 56. A spacer 130 of predetermined thickness is provided between each boss 106 and the radial flange 100 of the upstream annular segment 92. The axial position of the upstream annular segment 92 is set by the selection of the thickness of the spacer 130 so that the width of the annular slot 96 is adjusted depending on the engine specification determined by the use of a particular engine when the position of the downstream annular segment 94 is fixed.

The downstream annular segment 94 has a crateriform shape and is cantilevered (supported only by flange 112), and has an appropriate thickness so that the downstream annular segment 94 is elastically deformable when the air pressure within the impeller chamber 54 changes and, as a result, the width of the annular slot 96 changes in response to the changes in air pressure within the impeller chamber 54 during the operation of the compressor. The rein of the downstream annular segment 94 may be displaced axially. The annular slot 96 is defined between the end surface 102 and ramp surface 122 on the rein so that the displacement of the rein in the axial direction causes the change of the width of the slot 96.

The advantages of the single, annular, uninterrupted slot of the impeller bleed passage will now be described. The continuous annular single slot compares favourably to a series of bleed holes, in the prior art, because a series of holes with the same effective area would need to be larger in diameter than the width of a single slot. The length of the outer tip of the blade corresponding to the width of the blade passage is affected from the perspective of performance efficiency. The provision of a minimum possible width of this bleed passage, therefore, also provides the minimum possible length of the outer tip of the blade to be affected and, as a result, the impeller performance is improved.

The use of selective spacers to adjust the width of the annular slot during the assembly of the compressor advantageously extends this invention to broader applications and enable it to meet different engine requirements. For example, if the engine is being used on an aircraft to power the aircraft by means of a propeller, then the surges and pressure changes in the impeller during idle or cruising speeds may vary considerably. On the other hand, if the engine is being used as an auxiliary engine, for instance, in a Boeing 747 to power the hydraulics and electricals, then the requirements are quite different and the slot may be adjusted differently.

Furthermore, the elastically deformable downstream annular segment provides a self-regulating feature to the impeller bleed passage, that is, as pressure increases within the impeller chamber of the compressor, the slot width is reduced.

Another advantage of the invention is that the dynamic component caused by the pressure differential circle is eliminated because each of the upstream and downstream annular segments is independent and self-supporting at a peripheral edge adjacent the slot, without any bridge members crossing the slot which usually causes the pressure differential circle, as discussed previously.

The structure for the annular slot bleed passage is relatively simple, in contrast to the prior art, and less components and parts need to be used. For example, an O-ring seal is omitted in the present invention. The O-ring seal is used in the prior art to seal a socket connection between the inducer and the shroud. The O-ring seal prevents the pressurized air bled from the bleed holes from entering the inlet end of the shroud to cause a re-ingestion. This re-ingestion causes an impeller performance loss. However, since the upstream annular segment of the shroud, in this invention, is securely connected to the inducer using screw fasteners so that the possible clearance between the inlet end of the shroud and the inducer is eliminated. The simple structure provides a possibility to reduce the manufacturing costs.

Although a preferred embodiment of the invention has been disclosed, it should be apparent to those skilled in the art that the invention may be practical in other forms without departing from its spirit and scope which are only defined by the appended claims.

I claim:

1. A compressor for a gas turbine engine which includes a annular shroud having an inlet and an outlet end and an inner surface; a compressor rotor located within the shroud including a plurality of blades directed radially and outwardly from the rotor; the annular shroud comprising:

an upstream annular segment and a downstream annular segment independently supported and axially separated at a fixed distance a circumferentially continuous, uninterrupted annular slot being formed therebetween, such that the annular slot extends through the shroud.

2. A compressor as claimed in claim 1 wherein at least one of the segments is elastically deformable so that a width of the slot changes in response to changes in air pressure within the shroud during operation of the compressor.

3. A compressor as claimed in claim 2 wherein the slot width is adjustable for different engines to insure that a bleed action affected by the slot meets requirements of a particular engine when the compressor is used for the particular engine.

4. A compressor as claimed in claim 3 wherein the upstream annular segment is supported by a first casing structure and the downstream annular segment is supported by a second casing structure, each of the upstream and downstream annular segments independent and self-supporting at a peripheral edge adjacent the slot so that when the compressor is in operation, air passes through the continuous annular slot without causing a dynamic component which affects the blades.

5. A compressor as claimed in claim 4 wherein the slot width is adjustable by selecting an axial position in which the upstream annular segment is supported by the first casing structure.

6. A compressor as claimed in claim 5 wherein the upstream annular segment is connected to the first casing structure using a first fastening means including a spacer selected to set the axial position of the upstream annular segment so that the slot width is adjusted as predetermined.

7. A compressor as claimed in claim 4 wherein the downstream annular segment is connected to the second casing structure using a second fastening means including a spacer selected to set the shroud with the inner surface thereof in a close spaced relationship to an outer tip of each of the blades.

8. A compressor as claimed in claim 2 wherein the at least one deformable segment is the downstream annular segment.

9. A compressor as claimed in claim 8 wherein the annular slot is formed between an annular frusto-conical end surface of each of the upstream and downstream annular segments, the two annular end surfaces being parallel to each other and extending radially, outwardly and rearwardly so that the deformation of the downstream annular segment in an axial direction causes a change of the slot width.

10. A compressor as claimed in claim 7 wherein the downstream annular segment comprises a cylindrical portion and a radial flange on a downstream end thereof to be supported by the second casing structure so that the downstream annular segment is supported by the second casing structure in a cantilevered manner.

11. A compressor for a gas turbine engine which includes a stationary annular shroud having an inlet end and an outlet end and an inner surface; a rotor located within the shroud including a plurality of blades directed radially and outwardly from the rotor, each blade having an outer tip that is of similar contour to and located in a close spaced relationship to the inner surface of the shroud; the annular shroud comprising:

a upstream annular segment and a downstream annular segment axially spaced apart at a fixed distance to form a circumferentially continuous annular slot therebetween, the annular slot extending through the shroud, the upstream annular segment being supported by a first structure and the downstream annular segment being supported by a second structure, each of the upstream and downstream annular segments being independent and self-supporting at a peripheral edge adjacent the slot so that when the compressor is in operation, air passes through the continuous annular slot without causing a dynamic component which affects the blades.

12. A compressor as claimed in claim 11 wherein the first structure is an inducer which includes an annular passage in communication with the shroud at the inlet end for introduction of air flow into the shroud.

13. A compressor as claimed in claim 11 wherein the second structure is a casing by which the rotor is rotatably supported.

14. A compressor as claimed in claim 11 wherein a width of the slot is adjustable for different engines to insure that a bleed action effected by the slots meets requirements of a particular engine when the compressor is used for the particular engine.

15. A compressor as claimed in claim 14 wherein the upstream annular segment is connected to the first structure using a first fastening means including a spacer selected to set an axial position of the upstream annular segment so that the slot width is adjusted as predetermined.

16. A compressor as claimed in claim 11 wherein the downstream annular segment is connected to the second structure using second fastening means including a spacer selected to set the shroud with the inner surface thereof in the close spaced relationship to an outer tip of each of the blades.

17. A compressor as claimed in claim 11 wherein at least one of the segments is elastically deformable so that a width of the slot changes in response to changes in air pressure within the shroud during operation of the compressor.

18. A compressor as claimed in claim 17 wherein the at least one deformable segment is the downstream annular segment.

19. A compressor as claimed in claim 18 wherein the annular slot is formed between an annular end surface of each of the upstream and downstream annular segments, the two annular end surfaces being parallel to each other and extend radially, outwardly and rearwardly so that the deformation of the downstream annular segment in an axial direction causes a change of the slot width.

20. A method for providing an air bleed passage in association with a compressor for use in gas turbine engines, the compressor having an impeller assembly which includes an impeller rotor rotatably supported within an annular shroud having an inlet and an outlet, comprising:

producing the impeller shroud in two separate annular segments having an upstream annular segment and downstream annular segment;

supporting the upstream and downstream annular segments separately and independently in an axially fixed separated relationship to form a circumferentially continuous, uninterrupted annular slot therebetween, such that the annular slot extends through the shroud.

21. A method as claimed in claim 20 wherein the upstream and downstream annular segments are mounted respectively to a first and second structures in a cantilevered manner, each of the upstream and downstream annular segments independent and self-supporting at a peripheral edge adjacent the slot so that when the compressor is in operation, air passes through the continuous, uninterrupted annular slot without causing a dynamic component which affects the impeller rotor.

* * * * *